US011538429B2

(12) United States Patent
Hai

(10) Patent No.: US 11,538,429 B2
(45) Date of Patent: Dec. 27, 2022

(54) METHOD, DEVICE, SYSTEM, AND DISPLAY DEVICE FOR ADJUSTING LUMINANCE VIEWING ANGLE OF LIQUID CRYSTAL DISPLAY PANEL

(71) Applicant: Huizhou China Star Optoelectronics Technology Co., Ltd., Huizhou (CN)

(72) Inventor: Bo Hai, Huizhou (CN)

(73) Assignee: Huizhou China Star Optoelectronics Technology Co., Ltd., Huzhou (CN)

( * ) Notice: Subject to any disclaimer, the term of this patent is extended or adjusted under 35 U.S.C. 154(b) by 0 days.

(21) Appl. No.: 16/754,759

(22) PCT Filed: Jan. 7, 2020

(86) PCT No.: PCT/CN2020/070562
§ 371 (c)(1),
(2) Date: Apr. 9, 2020

(87) PCT Pub. No.: WO2021/128459
PCT Pub. Date: Jul. 1, 2021

(65) Prior Publication Data

US 2022/0319456 A1 Oct. 6, 2022

(30) Foreign Application Priority Data

Dec. 24, 2019 (CN) ..... 201911348807.3

(51) Int. Cl.
*G09G 3/36* (2006.01)

(52) U.S. Cl.
CPC ..... *G09G 3/3614* (2013.01); *G09G 3/3696* (2013.01); *G09G 2320/028* (2013.01);
(Continued)

(58) Field of Classification Search
CPC ..... G09G 3/3614; G09G 3/3696; G09G 2320/0233; G09G 2320/028; G09G 2320/0626; G09G 2360/16
See application file for complete search history.

(56) References Cited

U.S. PATENT DOCUMENTS 5,250,937 A 10/1993 Kikuo et al.
5,650,796 A * 7/1997 Owaki ..... G09G 3/3696 345/94

(Continued)

FOREIGN PATENT DOCUMENTS

CN 1308743 C 4/2007
CN 101499250 A 8/2009

(Continued)

*Primary Examiner* — Gene W Lee
(74) *Attorney, Agent, or Firm* — PV IP PC; Wei Te Chung; Ude Lu

(57) ABSTRACT

The present disclosure provides a method, a device, a system, and a display device for adjusting a luminance viewing angle of a liquid crystal display panel. The method obtains an actual value of a luminance viewing angle corresponding to a current image, adjusts a positive and negative polarity driving voltage when the actual value is less than a threshold value to obtain a relational expression between the positive and negative polarity driving voltage and the luminance viewing angle, processes a difference value between the actual value and the threshold value to obtain a target driving voltage value, and adjusts the positive and negative polarity driving voltage according to the target driving voltage value, thereby realizing adjustment of the luminance viewing angle.

9 Claims, 10 Drawing Sheets

(52) U.S. Cl.
CPC ..... *G09G 2320/0233* (2013.01); *G09G 2320/0626* (2013.01); *G09G 2360/16* (2013.01)

(56) References Cited

U.S. PATENT DOCUMENTS

| | | | | |
|---|---|---|---|---|
| 6,061,045 | A * | 5/2000 | Inaba | G09G 3/364 345/95 |
| 8,760,479 | B2 * | 6/2014 | Shin | G02F 1/136286 345/694 |
| 8,878,761 | B2 * | 11/2014 | Nakata | G02F 1/134309 345/95 |
| 9,099,048 | B2 | 8/2015 | Matsushima | |
| 9,348,188 | B2 * | 5/2016 | Shin | G02F 1/136286 |
| 10,783,846 | B2 * | 9/2020 | Chen | G09G 3/3607 |
| 11,188,169 | B2 * | 11/2021 | Chung | G02F 1/136222 |
| 11,289,041 | B2 * | 3/2022 | Huang | G09G 3/2022 |
| 2004/0125066 | A1 * | 7/2004 | Park | G09G 3/3648 345/92 |
| 2014/0354709 | A1 | 12/2014 | Mammen | |
| 2014/0375698 | A1 | 12/2014 | Zhang et al. | |
| 2017/0092213 | A1 | 3/2017 | Li et al. | |
| 2018/0082660 | A1 | 3/2018 | Xu et al. | |
| 2019/0221173 | A1 | 7/2019 | Lee | |
| 2020/0357323 | A1 | 11/2020 | Shan | |
| 2021/0012732 | A1 * | 1/2021 | Shan | G09G 3/3688 |

FOREIGN PATENT DOCUMENTS

| | | | |
|---|---|---|---|
| CN | 103413535 | A | 11/2013 |
| CN | 104240679 | A | 12/2014 |
| CN | 104464674 | A | 3/2015 |
| CN | 104698647 | A | 6/2015 |
| CN | 105528994 | A | 4/2016 |
| CN | 107085320 | A | 8/2017 |
| CN | 107358929 | A | 11/2017 |
| CN | 107808649 | A | 3/2018 |
| CN | 108281111 | A | 7/2018 |
| JP | H03259115 | A | 11/1991 |
| KR | 20070120825 | A | 12/2007 |
| WO | 2013051057 | A1 | 4/2013 |

* cited by examiner

METHOD, DEVICE, SYSTEM, AND DISPLAY DEVICE FOR ADJUSTING LUMINANCE VIEWING ANGLE OF LIQUID CRYSTAL DISPLAY PANEL

FIELD OF INVENTION

The present disclosure relates to the technology field of displays, and particularly, relates to a method, a device, a system, and a display device for adjusting a luminance viewing angle of a liquid crystal display panel.

BACKGROUND OF INVENTION

With development of liquid crystal devices, a liquid crystal display panel of a liquid crystal device has become an important research hotspot. For example, a liquid crystal display television (LCD TV) consists of a liquid crystal display panel (LCD panel) and a backlight. The liquid crystal display panel is one of the main factors that affect the luminance viewing angle. Wherein, the luminance viewing angle is an important parameter of the LCD TV. The greater luminance viewing angle, the slower a side view of luminance decreases. Because the human eye is sensitive to brightness, the higher brightness in a side view, the better viewing effect in the side view. Use requirements for the luminance viewing angle have gradually increased.

Technoligh Problems

In an implementation process, inventors found that the conventional technology has at least the following problems: a conventional process of improving the luminance viewing angle of a liquid crystal display device is complicated, a cost is high, and efficiency of improving the luminance viewing angle of the liquid crystal device is low.

Technoligh Solutions

Based on this, aim to the technology problems that the conventional process of improving the luminance viewing angle of a liquid crystal display device is complicated, the cost is high, and the efficiency is low, it is necessary to provide a method, a device, a system, and a display device for adjusting a luminance viewing angle of a liquid crystal display panel.

In order to achieve the above purposes, the embodiments of the present disclosure provide a method for adjusting a luminance viewing angle of a liquid crystal display panel, including following steps:

detecting a luminance viewing angle of a liquid crystal display panel according to a brightness value of a current image of the liquid crystal display panel, so as to obtain an actual value of the luminance viewing angle corresponding to the current image;

when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle;

according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage; and adjusting the positive and negative polarity driving voltage of the liquid crystal display panel according to the target driving voltage value.

The embodiments of the present disclosure also provide a system for adjusting a luminance viewing angle of a liquid crystal display panel, wherein the system includes a controller configured to be connected to the liquid crystal display panel, the controller is configured to perform following steps:

detecting a luminance viewing angle of a liquid crystal display panel according to a brightness value of a current image of the liquid crystal display panel, so as to obtain an actual value of the luminance viewing angle corresponding to the current image;

when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle;

according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage; and adjusting the positive and negative polarity driving voltage of the liquid crystal display panel according to the target driving voltage value.

The embodiments of the present disclosure also provide a display device including a liquid crystal display panel and a system for adjusting a luminance viewing angle of the liquid crystal display panel;

the system for adjusting the luminance viewing angle of the liquid crystal display panel includes a controller configured to be connected to the liquid crystal display panel, the controller is configured to perform following steps:

detecting a luminance viewing angle of a liquid crystal display panel according to a brightness value of a current image of the liquid crystal display panel, so as to obtain an actual value of the luminance viewing angle corresponding to the current image;

when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle;

according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage; and adjusting the positive and negative polarity driving voltage of the liquid crystal display panel according to the target driving voltage value.

Beneficial Effects

In each embodiment of the method for adjusting the luminance viewing angle of the liquid crystal display panel, a luminance viewing angle of a liquid crystal display panel is detected according to a brightness value of a current image of the liquid crystal display panel, so that an actual value of the luminance viewing angle corresponding to the current image is obtained. When the actual value of the luminance viewing angle is less than a threshold value of the luminance viewing angle, a positive and negative polarity driving voltage of the liquid crystal display panel is adjusted according to a preset step size, so that a relational expression between the positive and negative polarity driving voltage and the luminance viewing angle is obtained. According to the relational expression between the positive and negative polarity driving voltage and the luminance viewing angle, a difference value between the actual value of the luminance viewing angle and the threshold value of the luminance viewing angle is processed to obtain a target driving voltage value of the positive and negative polarity driving voltage. The positive and negative polarity driving voltage of the liquid crystal display panel is adjusted according to the target driving voltage value, thereby achieving adjustment of the luminance viewing angle of the liquid crystal display panel. The present disclosure can realize the adjustment of the luminance viewing angle of the liquid crystal display panel without changing pixel designs, thereby saving costs, simplifying process of improving the luminance viewing angle of the liquid crystal display device, and thereby increasing improvement efficiency of the luminance viewing angle of the liquid crystal display panel.

DESCRIPTION OF DRAWINGS

The present disclosure will be further described below with reference to the accompanying drawings and embodiments. In the drawings.

DETAILED DESCRIPTION OF EMBODIMENTS

In order to have a clearer understanding of the technical features, objects, and effects of the present disclosure, specific implementations of the present disclosure will now be described in detail with reference to the drawings.

Figure 1:
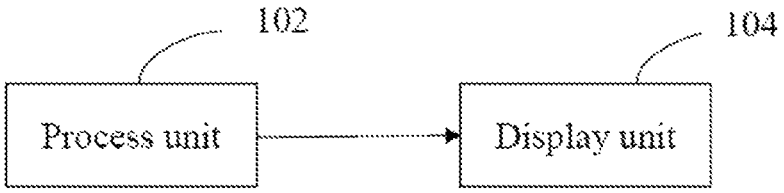
FIG. 1 is an application environment diagram of a method for adjusting a luminance viewing angle of a liquid crystal display panel in an embodiment.

A method for adjusting a luminance viewing angle of a liquid crystal display panel provided in the present disclosure may be applied in an application environment as shown in FIG. 1. Wherein, a process unit 102 is connected to a cc 104. The process unit 102 includes a processor. The processor may be, but is not limited to, a microcontroller or an advanced RISC machine (ARM, RISC microprocessor). The display unit 104 may be implemented by an independent display device or a display device combination composed of multiple display devices. Wherein, the display unit 104 may include a liquid crystal display panel. The liquid crystal display panel may be, but is not limited to, a TN panel, a VA panel, an IPS panel, or a CPA panel.

Figure 2:
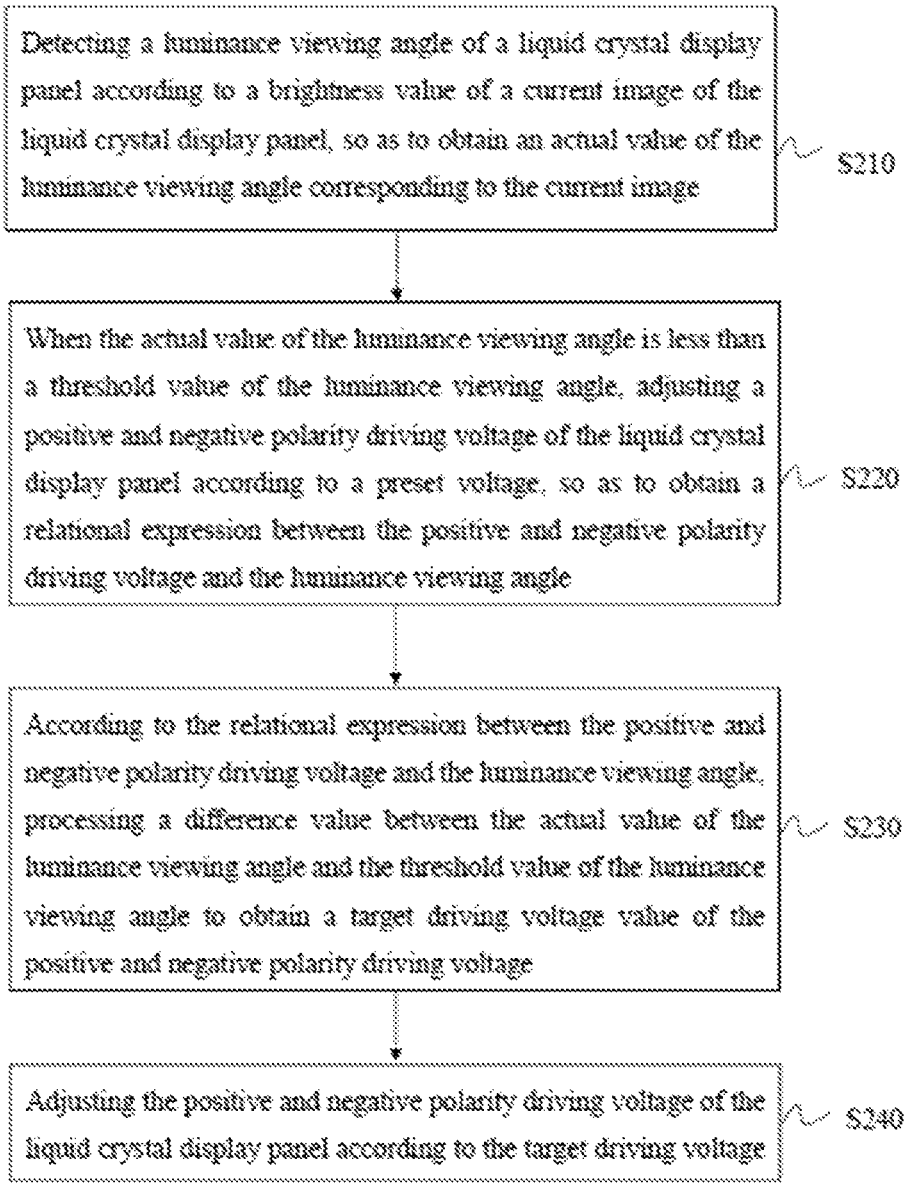
FIG. 2 is a first process diagram of a method for adjusting a luminance viewing angle of a liquid crystal display panel in an embodiment.

In an embodiment as shown in FIG. 2, a method for adjusting a luminance viewing angle of a liquid crystal display panel is provided. The method applied in the process unit 102 shown in FIG. 1 is taken as an example for description. The method includes following steps.

Step S210, detecting a luminance viewing angle of a liquid crystal display panel according to a brightness value of a current image of the liquid crystal display panel, so as to obtain an actual value of the luminance viewing angle corresponding to the current image.

Wherein, the brightness value of the current image can be represented by a grayscale value in a range of 0 to 255. The current image refers to a current image displayed according to RGB signals input to the liquid crystal display panel.

The luminance viewing angle refers to an angle at which users can clearly see all displayed contents on a screen from different directions. The luminance viewing angle may be a horizontal viewing angle or a vertical viewing angle. The horizontal viewing angle refers to: using a vertical normal of the screen as a reference, a direction perpendicular to the normal in which a user-approved image can be normally observed, the direction is at a certain angle range left or right of the normal, and the angle range is the horizontal viewing angle of the liquid crystal display. Similarly, if a horizontal normal is used as the reference, a viewing angle upon or below the normal is called the vertical viewing angle.

Specifically, the process unit can obtain the brightness value of the current image by detecting a luminance of the current image of the liquid crystal display panel. According to the brightness value of the current image, the process unit can detect the luminance viewing angle of the liquid crystal display panel to obtain the actual value of the luminance viewing angle corresponding to the current image.

In an example, the process unit may transmit a detection signal corresponding to a grayscale value of 255 to the liquid crystal display panel, that is, the current image of the liquid crystal display panel is a pure white image with a grayscale value of 255.

Step S220, when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle.

Wherein, the threshold value of the luminance viewing angle can be obtained according to a system preset. The preset step size can be determined according to experimental situations, for example, the preset step size may be 0.5V. The positive and negative polarity driving voltage refers to a positive polarity driving voltage and/or a negative polarity driving voltage for driving the liquid crystal display panel. The relational expression between the positive and negative polarity driving voltage and the luminance viewing angle may can be used to indicate a relationship between the driving voltage for adjusting the display panel and the luminance viewing angle corresponding to the driving voltage Specifically, the process unit may compare the processed actual value of the luminance viewing angle and the threshold value of the luminance viewing angle; according to the comparing result, when the actual value of the luminance viewing angle is less than the threshold value of the luminance viewing angle, the positive and negative polarity driving voltage of the liquid crystal display panel is sequentially adjusted according to the preset step size, and the luminance viewing angles corresponding to the positive and negative polarity driving voltages are obtained, so as to obtain the relational expression between the positive and negative polarity driving voltage and the luminance viewing angle is obtained according to each positive and negative polarity driving voltage and each luminance viewing angle.

Furthermore, according to the comparing result, when the actual value of the luminance viewing angle is equal to or larger than the threshold value of the luminance viewing angle, the process unit may stop adjusting process of the luminance viewing angles. That is, when the actual value of the luminance viewing angle is equal to or larger than the threshold value of the luminance viewing angle, the luminance viewing angle of the liquid crystal display panel meets the requirements.

Step S230, according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage.

Wherein, the target driving voltage value of the positive and negative polarity driving voltage refers to a voltage value of the positive and negative polarity driving voltage corresponding to the actual value of the luminance viewing angle.

Specifically, according to the relational expression between the positive and negative polarity driving voltage and the luminance viewing angle, the difference value between the actual value of the luminance viewing angle and the threshold value of the luminance viewing angle is calculated, and the target driving voltage value of the positive and negative polarity driving voltage is obtained based on the difference value between the actual value of the luminance viewing angle and the threshold value of the luminance viewing angle.

Step S240, adjusting the positive and negative polarity driving voltage of the liquid crystal display panel according to the target driving voltage value.

Wherein, the positive and negative polarity driving voltage refers to a voltage that drives the liquid crystal display panel to light up. In one example, the larger the positive polarity driving voltage, the smaller the negative polarity driving voltage, and the greater the brightness of the liquid crystal display panel.

Specifically, the process unit adjusts the positive and negative polarity driving voltages of the liquid crystal display panel according to the target driving voltage value obtained by the processing, and then drives the liquid crystal display panel to work based on the adjusted positive and negative polarity driving voltages, so that the luminance viewing angle of the liquid crystal display panel is adjusted to meet the threshold value of the luminance viewing angle.

In the above embodiment of the method for adjusting the luminance viewing angle of the liquid crystal display panel, a luminance viewing angle of a liquid crystal display panel is detected according to a brightness value of a current image of the liquid crystal display panel, so that an actual value of the luminance viewing angle corresponding to the current image is obtained. When the actual value of the luminance viewing angle is less than a threshold value of the luminance viewing angle, a positive and negative polarity driving voltage of the liquid crystal display panel is adjusted according to a preset step size, so that a relational expression between the positive and negative polarity driving voltage and the luminance viewing angle is obtained. According to the relational expression between the positive and negative polarity driving voltage and the luminance viewing angle, a difference value between the actual value of the luminance viewing angle and the threshold value of the luminance viewing angle is processed to obtain a target driving voltage value of the positive and negative polarity driving voltage. The positive and negative polarity driving voltage of the liquid crystal display panel is adjusted according to the target driving voltage value, thereby achieving adjustment of the luminance viewing angle of the liquid crystal display panel. The adjustment of the luminance viewing angle of the liquid crystal display panel is realized without changing pixel designs, thereby saving costs, simplifying process of improving the luminance viewing angle of the liquid crystal display device, and thereby increasing improvement efficiency of the luminance viewing angle of the liquid crystal display panel.

Figure 3:
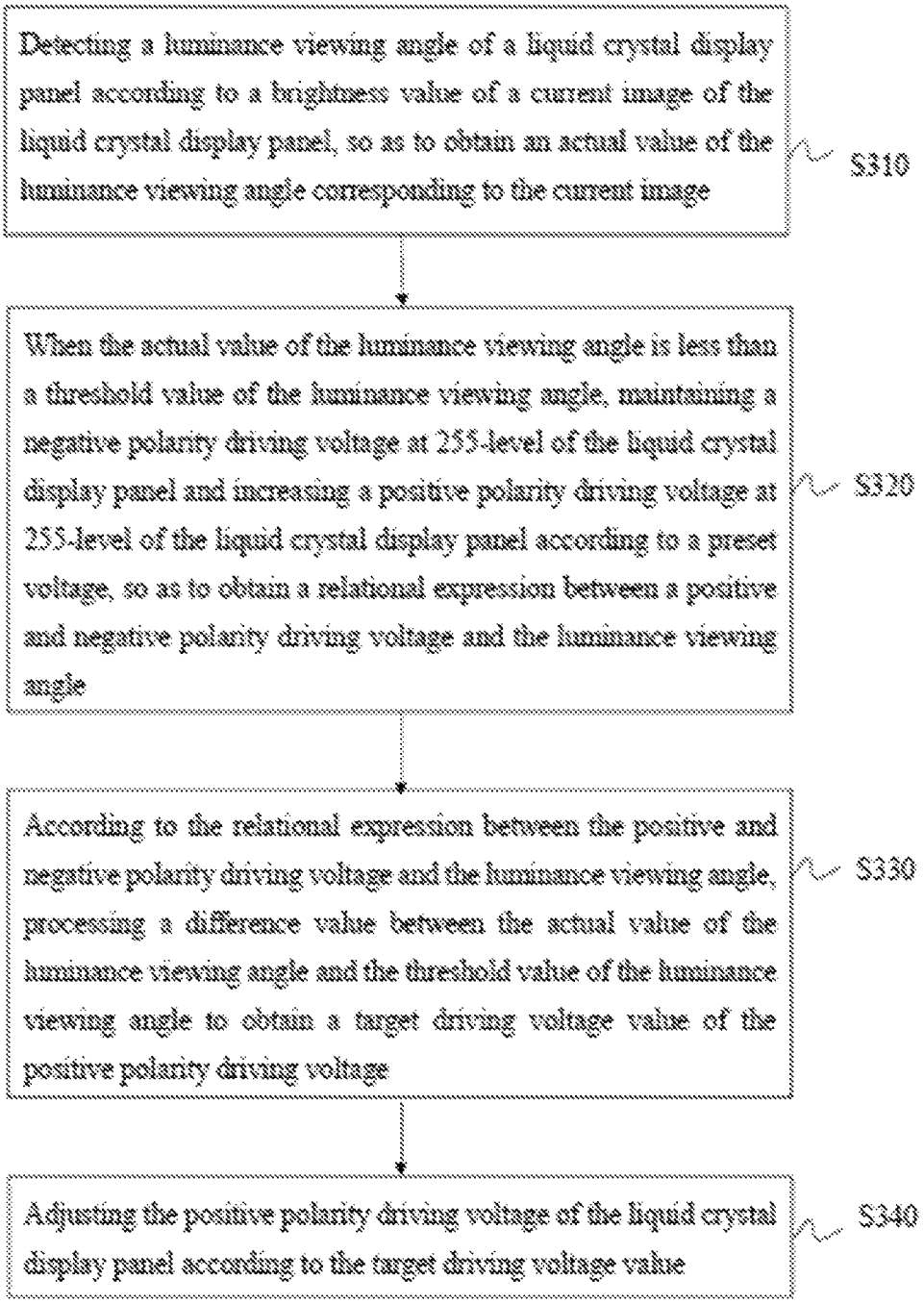
FIG. 3 is a second process diagram of a method for adjusting a luminance viewing angle of a liquid crystal display panel in an embodiment.

In an embodiment as shown in FIG. 3, a method for adjusting a luminance viewing angle of a liquid crystal display panel is provided. The method applied in the process unit 102 shown in FIG. 1 is taken as an example for description. The method includes following steps.

Step S310, detecting a luminance viewing angle of a liquid crystal display panel according to a brightness value of a current image of the liquid crystal display panel, so as to obtain an actual value of the luminance viewing angle corresponding to the current image.

Step S320, when the actual value of the luminance viewing angle is less than a threshold value of the luminance viewing angle, maintaining a negative polarity driving voltage at 255-level of the liquid crystal display panel and increasing a positive polarity driving voltage at 255-level of the liquid crystal display panel according to a preset step size, so as to obtain a relational expression between a positive and negative polarity driving voltage and the luminance viewing angle.

Step S330, according to the relational expression between the positive and negative polarity driving voltage and the luminance viewing angle, processing a difference value between the actual value of the luminance viewing angle and the threshold value of the luminance viewing angle to obtain a target driving voltage value of the positive polarity driving voltage.

Step S340, adjusting the positive polarity driving voltage of the liquid crystal display panel according to the target driving voltage value.

Specifically, the driving voltage of the liquid crystal display panel includes a positive polarity driving voltage, a negative polarity driving voltage, and a common voltage (VCOM voltage). The process unit may detect a luminance viewing angle of a liquid crystal display panel according to a brightness value of a current image of the liquid crystal display panel, so that an actual value of the luminance viewing angle corresponding to the current image is obtained. The process unit may compare the actual value of the luminance viewing angle and a threshold value of the luminance viewing angle, when the actual value of the luminance viewing angle is less than the threshold value of the luminance viewing angle, a negative polarity driving voltage at 255-level of the liquid crystal display panel is maintained and a positive polarity driving voltage at 255-level of the liquid crystal display panel is increased according to a preset step size, so that a relational expression between the positive and negative polarity driving voltage and the luminance viewing angle is obtained. According to the relational expression between the positive and negative polarity driving voltage and the luminance viewing angle, a difference value between the actual value of the luminance viewing angle and the threshold value of the luminance viewing angle is calculated. The process unit may obtain a target driving voltage value of the 225-level positive polarity driving voltage according to the difference value between the actual value of the luminance viewing angle and the threshold value of the luminance viewing angle. The positive polarity driving voltage at 255-level is increased to the target driving voltage value. The liquid crystal display panel is driven according to the increased positive polarity driving voltage at 255-level, thereby realizing adjustment of the luminance viewing angle of the liquid crystal display panel.

Preferably, a range of the positive polarity driving voltage for a white image having a 255-level brightness of the liquid crystal display panel is 10V to 20V (volt).

In this embodiment, based on the threshold value of the luminance viewing angle, that the current liquid crystal display panel needs to increase the luminance viewing angle is judged, and the corresponding relationship between the luminance viewing angle and the positive polarity driving voltage is used to obtain the actual positive polarity driving voltage that needs to be changed. Furthermore, by maintaining the negative polarity driving voltage of the liquid crystal display panel and adjusting the positive polarity driving voltage of the current image of the liquid crystal display panel, adjustment of the luminance viewing angle of the liquid crystal display panel is realized. The adjustment of the luminance viewing angle of the liquid crystal display panel is realized without changing pixel designs, thereby saving costs, simplifying process of improving the luminance viewing angle of the liquid crystal display device, and thereby increasing improvement efficiency of the luminance viewing angle of the liquid crystal display panel.

It should be noted that each gray scale of the liquid crystal display panel corresponds to a positive polarity voltage, a negative polarity voltage, and a common voltage, respectively. The voltage applied to the liquid crystal is the difference values between the positive voltage, the negative voltage, and the common voltage.

In an example, multiple sets of historical data (including historical luminance viewing angle and historical positive polarity driving voltage) can be tested experimentally, and according to multiple sets of historical data, the corresponding relationship between the luminance viewing angle and the positive polarity driving voltage can be obtained. Furthermore, based on the corresponding relationship between the luminance viewing angle and the positive polarity driving voltage, the difference value between the actual value of the luminance viewing angle and the threshold value of the luminance viewing angle can be processed to obtain the target driving voltage value of the positive polarity driving voltage.

Figure 4:
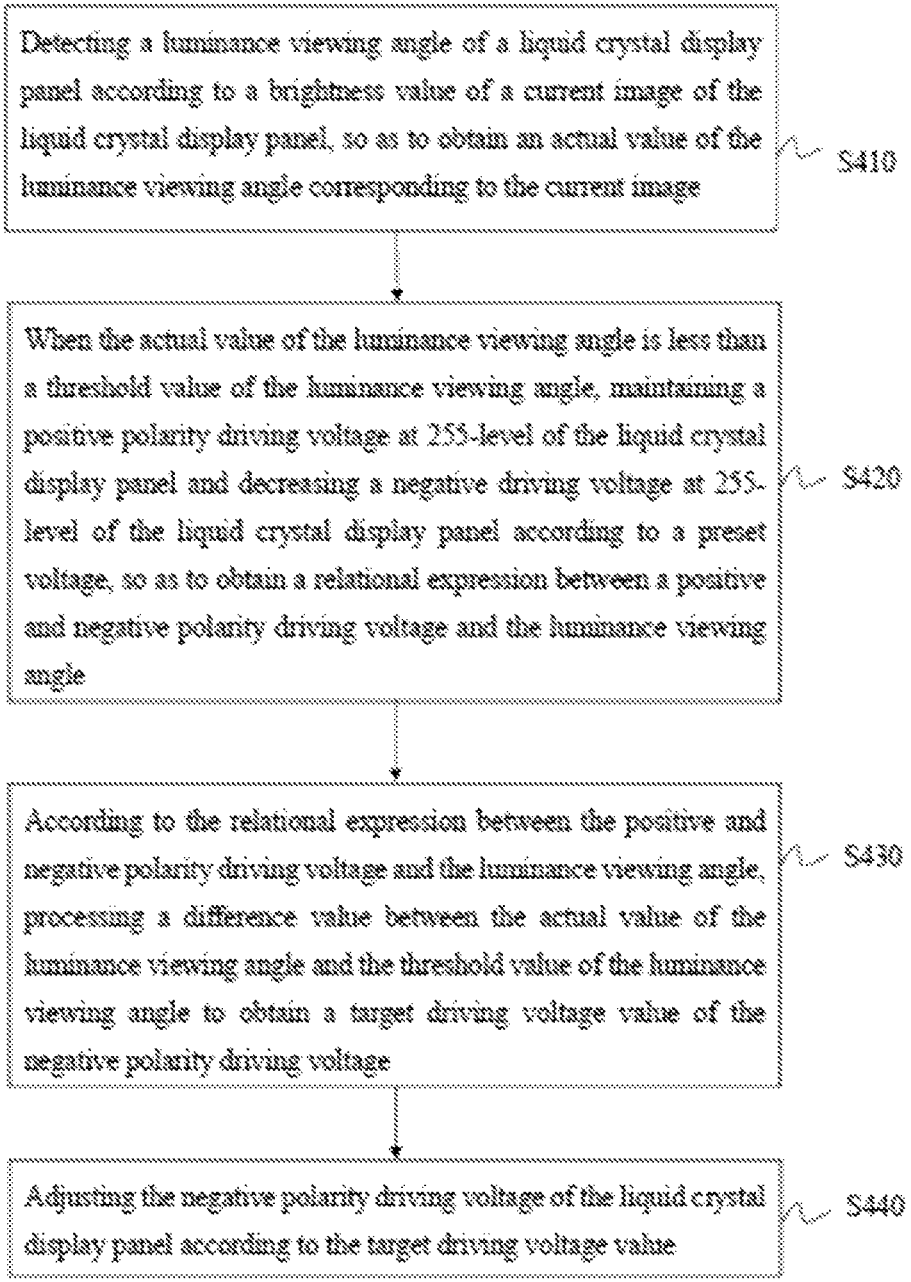
FIG. 4 is a third process diagram of a method for adjusting a luminance viewing angle of a liquid crystal display panel in an embodiment.

In an embodiment as shown in FIG. 4, a method for adjusting a luminance viewing angle of a liquid crystal display panel is provided. The method applied in the process unit 102 shown in FIG. 1 is taken as an example for description. The method includes following steps.

Step S410, detecting a luminance viewing angle of a liquid crystal display panel according to a brightness value of a current image of the liquid crystal display panel, so as to obtain an actual value of the luminance viewing angle corresponding to the current image.

Step S420, when the actual value of the luminance viewing angle is less than a threshold value of the luminance viewing angle, maintaining a positive polarity driving voltage at 255-level of the liquid crystal display panel and decreasing a negative driving voltage at 255-level of the liquid crystal display panel according to a preset step size, so as to obtain a relational expression between a positive and negative polarity driving voltage and the luminance viewing angle.

Step S430, according to the relational expression between the positive and negative polarity driving voltage and the luminance viewing angle, processing a difference value between the actual value of the luminance viewing angle and the threshold value of the luminance viewing angle to obtain a target driving voltage value of the negative polarity driving voltage.

Step S440, adjusting the negative polarity driving voltage of the liquid crystal display panel according to the target driving voltage value.

Specifically, the driving voltage of the liquid crystal display panel includes a positive polarity driving voltage, a negative polarity driving voltage, and a common voltage (VCOM voltage). The process unit may detect a luminance viewing angle of a liquid crystal display panel according to a brightness value of a current image of the liquid crystal display panel, so that an actual value of the luminance viewing angle corresponding to the current image is obtained. The process unit may compare the actual value of the luminance viewing angle and a threshold value of the luminance viewing angle, when the actual value of the luminance viewing angle is less than the threshold value of the luminance viewing angle, a positive polarity driving voltage at 255-level of the liquid crystal display panel is maintained and a negative polarity driving voltage at 255-level of the liquid crystal display panel is decreased according to a preset step size, so that a relational expression between the positive and negative polarity driving voltage and the luminance viewing angle is obtained. According to the relational expression between the positive and negative polarity driving voltage and the luminance viewing angle, a difference value between the actual value of the luminance viewing angle and the threshold value of the luminance viewing angle is calculated. The process unit may obtain a target driving voltage value of the 225-level negative polarity driving voltage according to the difference value between the actual value of the luminance viewing angle and the threshold value of the luminance viewing angle. The 225-level negative polarity driving voltage is decreased to the target driving voltage value. The liquid crystal display panel is driven according to the decreased negative polarity driving voltage at 255-level, thereby realizing adjustment of the luminance viewing angle of the liquid crystal display panel.

Preferably, a range of the negative polarity driving voltage for a white image having a 255-level brightness of the liquid crystal display panel is 0V to 2V (volt).

In this embodiment, based on the threshold value of the luminance viewing angle, that the current liquid crystal display panel needs to increase the luminance viewing angle is judged, and the corresponding relationship between the luminance viewing angle and the negative polarity driving voltage is used to obtain the actual negative polarity driving voltage that needs to be changed. Furthermore, by maintaining the positive polarity driving voltage of the liquid crystal display panel and adjusting the negative polarity driving voltage of the current image of the liquid crystal display panel, adjustment of the luminance viewing angle of the liquid crystal display panel is realized. The adjustment of the luminance viewing angle of the liquid crystal display panel is realized without changing pixel designs, thereby saving costs, simplifying process of improving the luminance viewing angle of the liquid crystal display device, and thereby increasing improvement efficiency of the luminance viewing angle of the liquid crystal display panel.

In an example, multiple sets of historical data (including historical luminance viewing angle and historical negative polarity driving voltage) can be tested experimentally, and according to multiple sets of historical data, the corresponding relationship between the luminance viewing angle and the negative polarity driving voltage can be obtained. Furthermore, based on the corresponding relationship between the luminance viewing angle and the negative polarity driving voltage, the difference value between the actual value of the luminance viewing angle and the threshold value of the luminance viewing angle can be processed to obtain the target driving voltage value of the negative polarity driving voltage.

Figure 5:
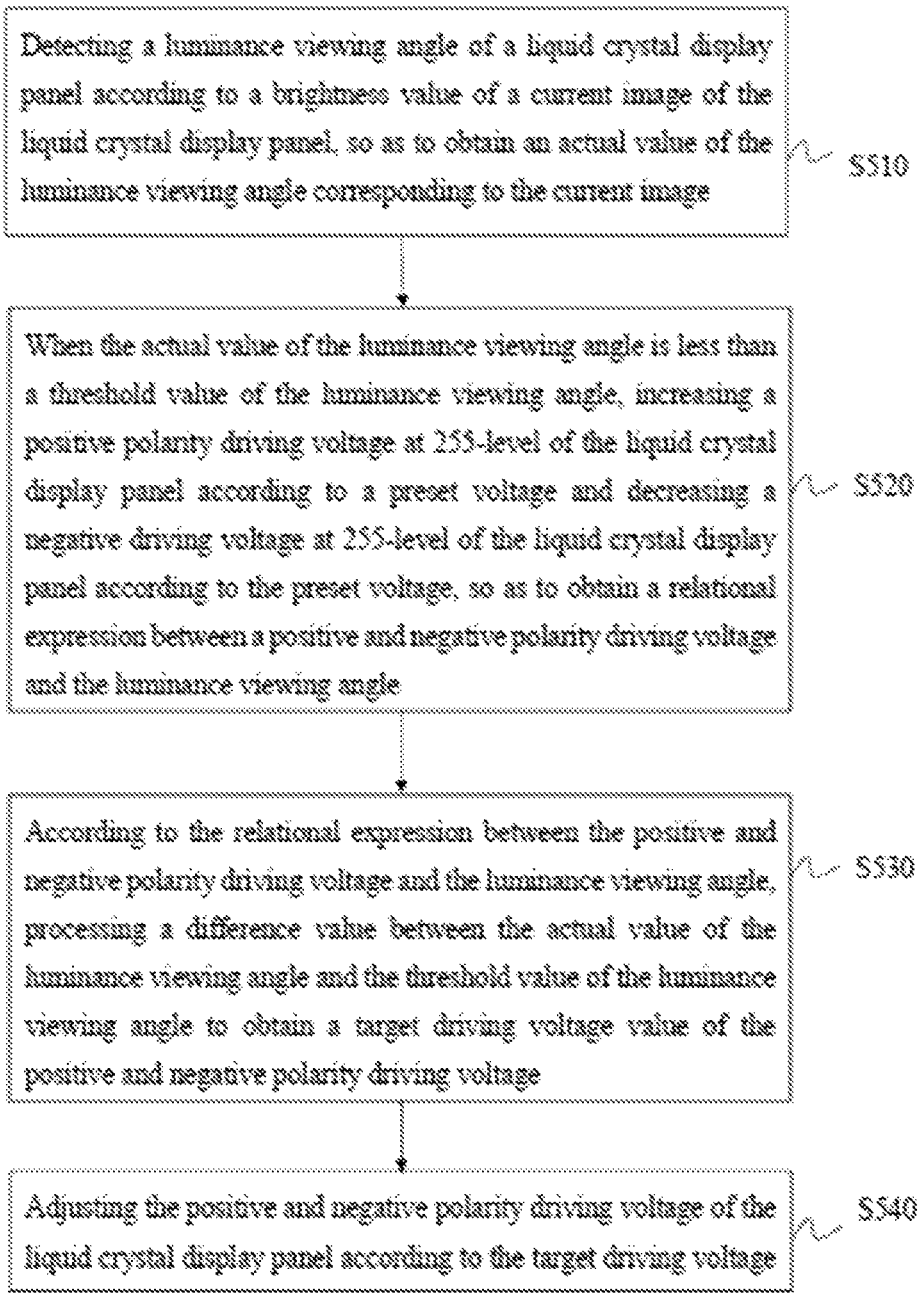
FIG. 5 is a fourth process diagram of a method for adjusting a luminance viewing angle of a liquid crystal display panel in an embodiment.

In an embodiment as shown in FIG. 5, a method for adjusting a luminance viewing angle of a liquid crystal display panel is provided. The method applied in the process unit 102 shown in FIG. 1 is taken as an example for description. The method includes following steps.

Step S510, detecting a luminance viewing angle of a liquid crystal display panel according to a brightness value of a current image of the liquid crystal display panel, so as to obtain an actual value of the luminance viewing angle corresponding to the current image.

Step S520, when the actual value of the luminance viewing angle is less than a threshold value of the luminance viewing angle, increasing a positive polarity driving voltage at 255-level of the liquid crystal display panel according to a preset step size and decreasing a negative driving voltage at 255-level of the liquid crystal display panel according to the preset step size, so as to obtain a relational expression between a positive and negative polarity driving voltage and the luminance viewing angle.

Step S530, according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage.

Step S540, adjusting the positive and negative polarity driving voltage of the liquid crystal display panel according to the target driving voltage value.

Specifically, the driving voltage of the liquid crystal display panel includes a positive polarity driving voltage, a negative polarity driving voltage, and a common voltage (VCOM voltage). The process unit may detect a luminance viewing angle of a liquid crystal display panel according to a brightness value of a current image of the liquid crystal display panel, so that an actual value of the luminance viewing angle corresponding to the current image is obtained. The process unit may compare the actual value of the luminance viewing angle and a threshold value of the luminance viewing angle, when the actual value of the luminance viewing angle is less than the threshold value of the luminance viewing angle, a positive polarity driving voltage at 255-level of the liquid crystal display panel is increased according to a preset step size and a negative polarity driving voltage at 255-level of the liquid crystal display panel is decreased according to the preset step size, so that a relational expression between the positive and negative polarity driving voltage and the luminance viewing angle is obtained. According to the relational expression between the positive and negative polarity driving voltage and the luminance viewing angle, a difference value between the actual value of the luminance viewing angle and the threshold value of the luminance viewing angle is calculated. The process unit may obtain a target driving voltage value of the 225-level positive polarity driving voltage and a target driving voltage value of the 225-level negative polarity driving voltage according to the difference value between the actual value of the luminance viewing angle and the threshold value of the luminance viewing angle. The 225-level positive polarity driving voltage is increased to the target driving voltage value of the positive polarity driving voltage, and the 225-level negative polarity driving voltage is decreased to the target driving voltage value of the negative polarity driving voltage. The liquid crystal display panel is driven according to the increased positive polarity driving voltage at 255-level and the decreased negative polarity driving voltage at 255-level, thereby realizing adjustment of the luminance viewing angle of the liquid crystal display panel.

In this embodiment, based on the threshold value of the luminance viewing angle, that the current liquid crystal display panel needs to increase the luminance viewing angle is judged, and the corresponding relationship between the luminance viewing angle and the positive and negative polarity driving voltage is used to obtain the actual positive polarity driving voltage and the actual negative polarity driving voltage that need to be changed. Furthermore, by adjusting the positive polarity driving voltage and the negative polarity driving voltage of the current image of the liquid crystal display panel, adjustment of the luminance viewing angle of the liquid crystal display panel is realized. The adjustment of the luminance viewing angle of the liquid crystal display panel is realized without changing pixel designs, thereby saving costs, simplifying process of improving the luminance viewing angle of the liquid crystal display device, and thereby increasing improvement efficiency of the luminance viewing angle of the liquid crystal display panel.

In an example, multiple sets of historical data (including historical luminance viewing angle, historical positive polarity driving voltage, and historical negative polarity driving voltage) can be tested experimentally, and according to multiple sets of historical data, the corresponding relationships between the luminance viewing angle and the positive polarity driving voltage and between the luminance viewing angle and negative polarity driving voltage can be obtained.

Furthermore, based on the corresponding relationships between the luminance viewing angle and the positive polarity driving voltage, the difference value between the actual value of the luminance viewing angle and the threshold value of the luminance viewing angle can be processed to obtain the target driving voltage value of the positive polarity driving voltage. Based on the corresponding relationships between the luminance viewing angle and the negative polarity driving voltage, the difference value between the actual value of the luminance viewing angle and the threshold value of the luminance viewing angle can be processed to obtain the target driving voltage value of the negative polarity driving voltage.

In an embodiment, the luminance viewing angle may be a ⅓ luminance viewing angle. The ⅓ luminance viewing angle refers to a viewing angle (horizontal viewing angle or vertical viewing angle) of the luminance viewing angle when brightness in screen center of the liquid crystal display panel is reduced to one third. The luminance viewing angle may also be a ½ luminance viewing angle. The ½ luminance viewing angle refers to a viewing angle (horizontal viewing angle or vertical viewing angle) of the luminance viewing angle when brightness in screen center of the liquid crystal display panel is reduced to one-half. It should be noted that the luminance viewing angle is not limited to a ⅓ luminance viewing angle or a ½ luminance viewing angle, and may also be a viewing angle corresponding to other brightness values.

Figure 6:
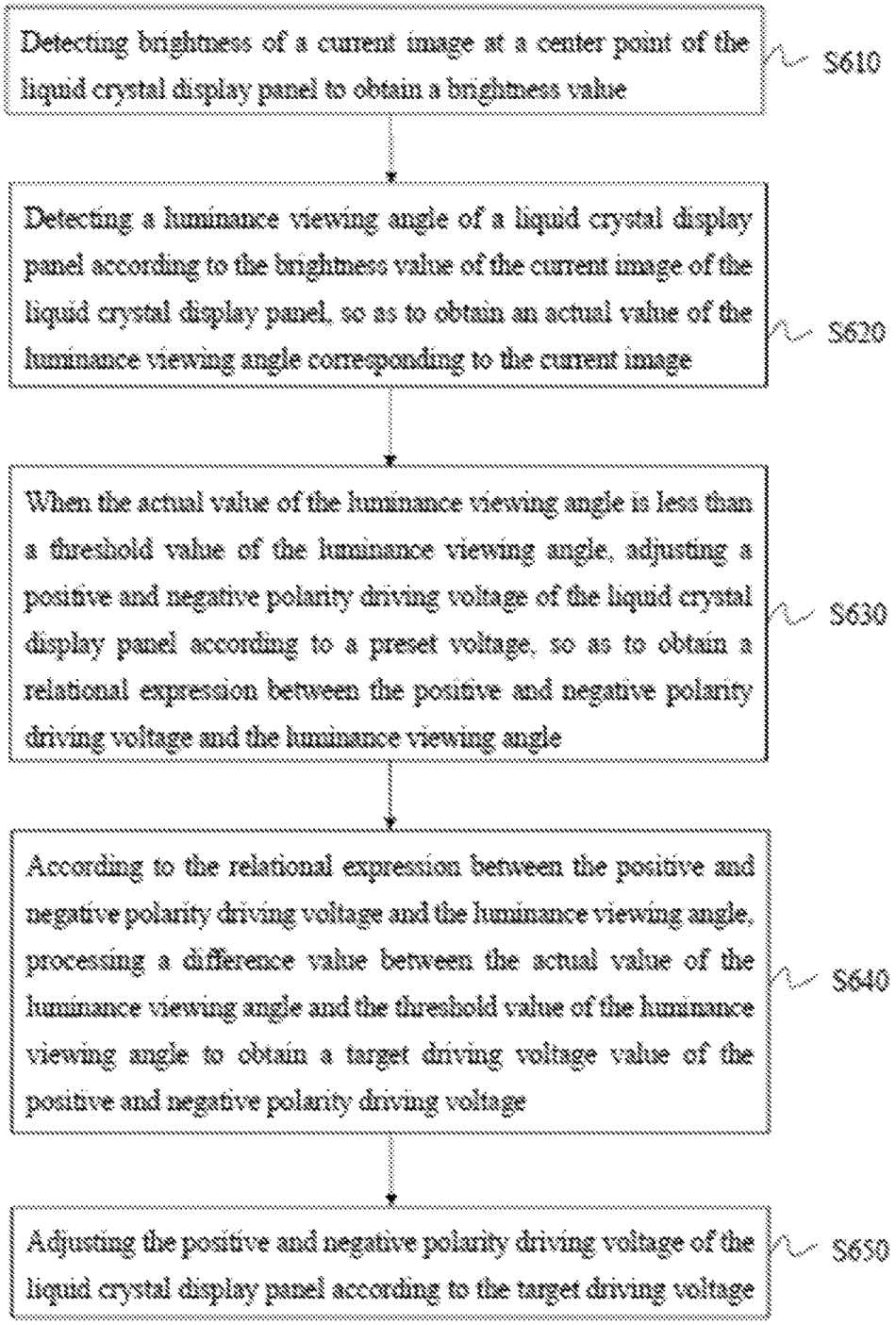
FIG. 6 is a fifth process diagram of a method for adjusting a luminance viewing angle of a liquid crystal display panel in an embodiment.

In an embodiment as shown in FIG. 6, a method for adjusting a luminance viewing angle of a liquid crystal display panel is provided. The method applied in the process unit 102 shown in FIG. 1 is taken as an example for description. The method includes following steps.

Step S610, detecting brightness of a current image at a center point of the liquid crystal display panel to obtain a brightness value.

Step S620, detecting a luminance viewing angle of a liquid crystal display panel according to the brightness value of the current image of the liquid crystal display panel, so as to obtain an actual value of the luminance viewing angle corresponding to the current image.

Step S630, when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle.

Step S640, according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage.

Step S650, adjusting the positive and negative polarity driving voltage of the liquid crystal display panel according to the target driving voltage value.

Wherein, specific content processes of the above steps S620, S630, S640, and S650 may refer to the foregoing contents, and details are not described herein again.

Specifically, the process unit detects brightness of a current image at a center point of the liquid crystal display panel to obtain a brightness value of the current image. For example, the process unit may include an optical measuring instrument. The optical measuring instrument may be placed in front of the liquid crystal display panel, and an optical axis of the optical measuring instrument may be orthogonal to a central area of the liquid crystal display panel. The brightness of the center point of the liquid crystal display panel is measured by the optical measuring instrument, and a measurement position of the center point is maintained, and the optical measurement device (or the liquid crystal display panel) is rotated successively, and then brightness of different angles horizontally and vertically can be measured.

The measured brightness changes with the change of the measured angle. When the measured brightness is ⅓ of brightness at an angle of 0 degree, the measured angle is recorded. Furthermore, a horizontal ⅓ viewing angle (that is, sum of the left and right angles in the horizontal direction) and a vertical ⅓ viewing angle (that is, sum of the up and down angles in the vertical direction) can be obtained.

In this embodiment, by obtaining an actual value of the luminance viewing angle corresponding to the current image of the liquid crystal display panel and processing the obtained luminance viewing angle, a corresponding difference value of voltage to be adjusted can be obtained, and the positive and negative polarity driving voltage of the liquid crystal display panel can be adjusted according to the difference value of voltage to be adjusted. So that the adjustment of the luminance viewing angle of the liquid crystal display panel is realized without changing pixel designs, thereby saving costs, simplifying process of improving the luminance viewing angle of the liquid crystal display device, and thereby increasing improvement efficiency of the luminance viewing angle of the liquid crystal display panel.

In an embodiment, the current image of the liquid crystal display panel is an image having a 255-level brightness. Wherein, the image having a 255-level brightness refers to a pure white image.

Figure 7:
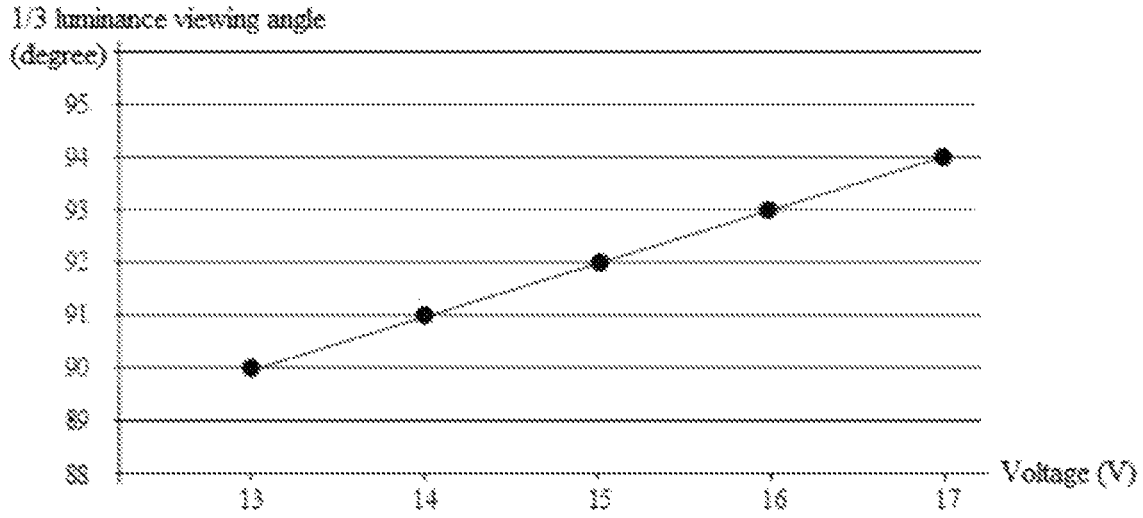
FIG. 7 is a curve schematic diagram shows a relationship between a luminance viewing angle and a voltage of a liquid crystal display panel in an embodiment.

For example, as shown in FIG. 7, that the current image of the liquid crystal display panel is a white image at 255-level and the luminance viewing angle is ⅓ luminance viewing angle is taken as an example for description.

Different voltages (13V, 14V, 15V, 16V, and 17V) for the white image at 255-level are adjusted, the brightness of different luminance viewing angles are recorded, and corresponding luminance viewing angles (90 degrees, 91 degrees, 92 degrees, 93 degrees, and 94 degrees) are calculated by calculating the ⅓ luminance viewing angle. So that an influence trend of the voltage on the luminance viewing angle according to the white image at 255-level is obtained. It can be seen from the figure that, when the voltage of the white image at 255-level is increased by 1V, the ⅓ luminance viewing angle is increased by about 1 degree.

In order to solve the problems of complicated processes, high costs, and low improvement efficiency in the conventional method for improving the luminance viewing angle of a liquid crystal display device, in an embodiment, the adjusting principle and process of the luminance viewing angle of the liquid crystal display panel are specifically described.

Figure 8:
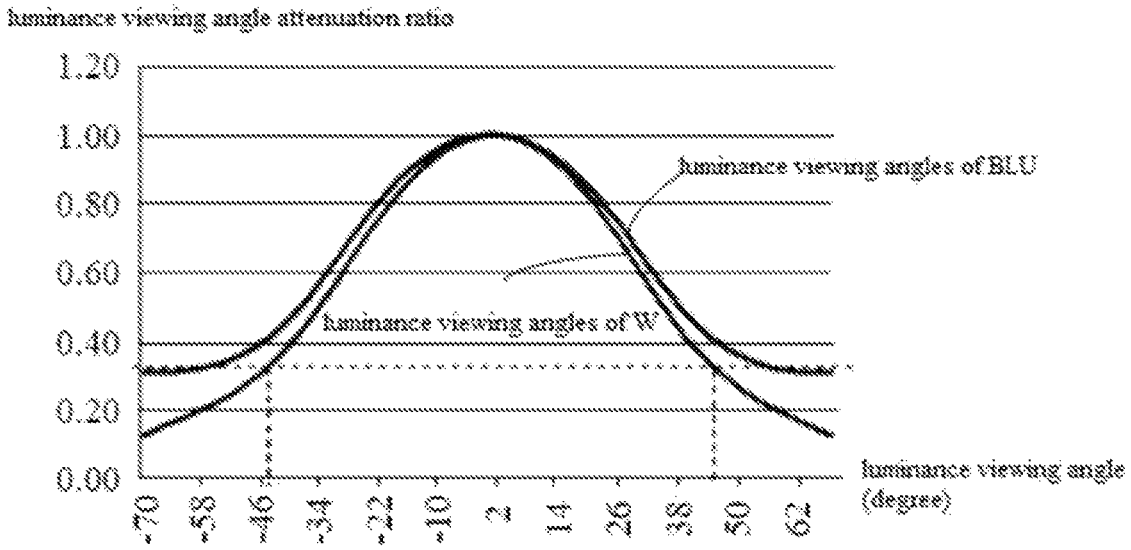
FIG. 8 shows curve schematic diagrams of a luminance viewing angle of a white image and a luminance viewing angle of a backlight unit in a liquid crystal display panel of an embodiment.

As shown in FIG. 8, the luminance viewing angles of the white image (W) at 255-level and the backlight unit (BLU) of the liquid crystal display panel are measured separately. The ⅓ luminance viewing angle of the white image (W) at 255-level is 89 degrees, and the ⅓ luminance viewing angle of the backlight unit (BLU) is 112 degrees. It can be seen that the luminance viewing angle of the white image (W) at 255-level and the luminance viewing angle of the backlight unit (BLU) are different. The luminance viewing angle of the backlight unit (BLU) is larger than the luminance viewing angle of the white image (W) at 255-level. That is, the liquid crystal display panel reduces the luminance viewing angle of the backlight unit. Therefore, influence of the liquid crystal display panel on the luminance viewing angle needs to be reduced.

Figure 9:
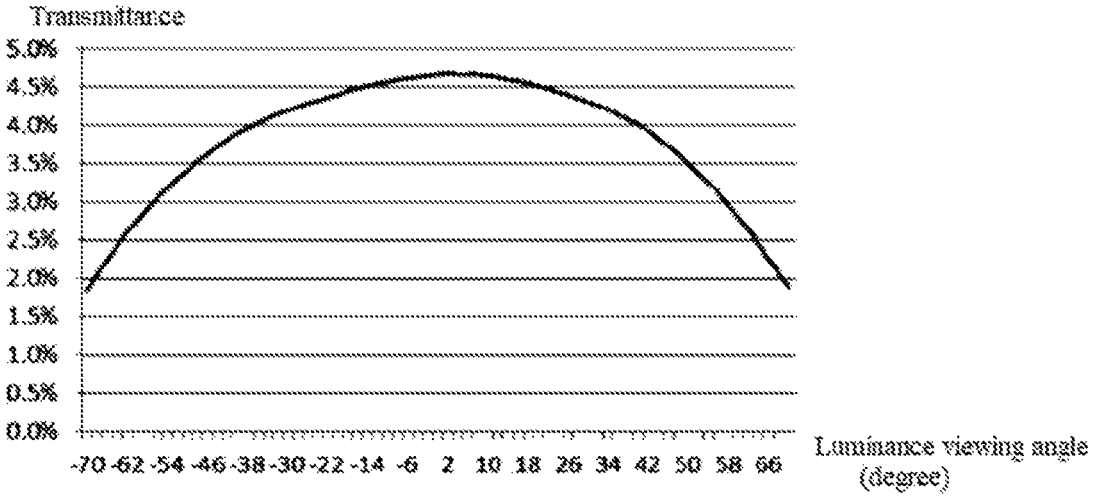
FIG. 9 shows a curve schematic diagram of a transmittance of a liquid crystal display panel of an embodiment.

Further, as shown in FIG. 9, through analysis, the reason why the liquid crystal display panel narrows the luminance viewing angle is that: as the luminance viewing angle increases, transmittance of the liquid crystal display panel gradually decreases. Brightness of the white image at 255-level is the product of brightness of the backlight unit and transmittance. That is, to improve the narrowing of the luminance viewing angle of the liquid crystal display panel needs to improve the transmissivity of the liquid crystal display panel from the side view to the front view, reduction in viewing angle penetration is reduced.

Figure 10:
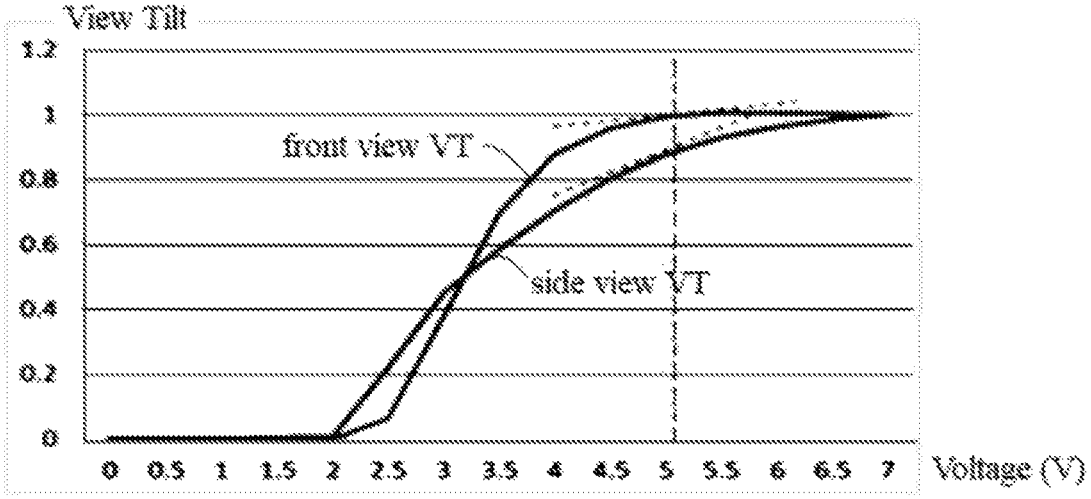
FIG. 10 shows curve schematic diagrams of a view tilt in a front view and a view tilt in a side view of an embodiment.

Further, as shown in FIG. 10, by increasing the voltage of the white image at 255-level, the front view tilt (front view VT) is easier to approach the saturation region, and the side view tilt (side view VT) is not saturated. When the change in the front view tilt is less than the change in the side view tilt, the side view transmittance (side view Tr) gains faster than the front view transmittance (front view Tr), and the ratio of the side view transmittance and the front view transmittance increases, thereby improving the luminance viewing angle of the white image at 255-level. It should be noted: the transmittance of the side view angle refers to a value that the side view brightness of the white image at 255-level is divided by the side view brightness of the backlight unit, and the transmittance of the front view angle refers to a value that the front view brightness of the white image at 255-level is divided by the front view brightness of the backlight unit.

Based on experimental analysis, by changing the driving voltage based on the white image at 255-level, it was found that the higher the corresponding voltage based on the white image at 255-level, the wider the luminance viewing angle. That is, increasing the voltage of the white image at 255-level can effectively improve the luminance viewing angle of the white image (W) at 255-level. Therefore, the embodiments of the present disclosure can realize the adjustment of the luminance viewing angle of the liquid crystal display panel without changing pixel designs, thereby saving costs, simplifying process of improving the luminance viewing angle of the liquid crystal display device, and thereby increasing improvement efficiency of the luminance viewing angle of the liquid crystal display panel.

It should be understood that although the steps in the flowcharts of FIG. 2 and FIG. 6 are sequentially displayed according to the directions of the arrows, these steps are not necessarily performed sequentially in the order indicated by the arrows. Unless explicitly stated herein, the execution of these steps is not strictly limited, and these steps may be performed in other orders. Moreover, at least a part of the steps in FIG. 2 and FIG. 6 may include multiple sub-steps or multiple stages. These sub-steps or stages are not necessarily performed at the same time, but may be performed at different times. The execution order of these sub-steps or stages is not necessarily performed sequentially, but may be performed in turn or alternately with at least a part of the sub-steps or stages of other steps or other steps.

Figure 11:
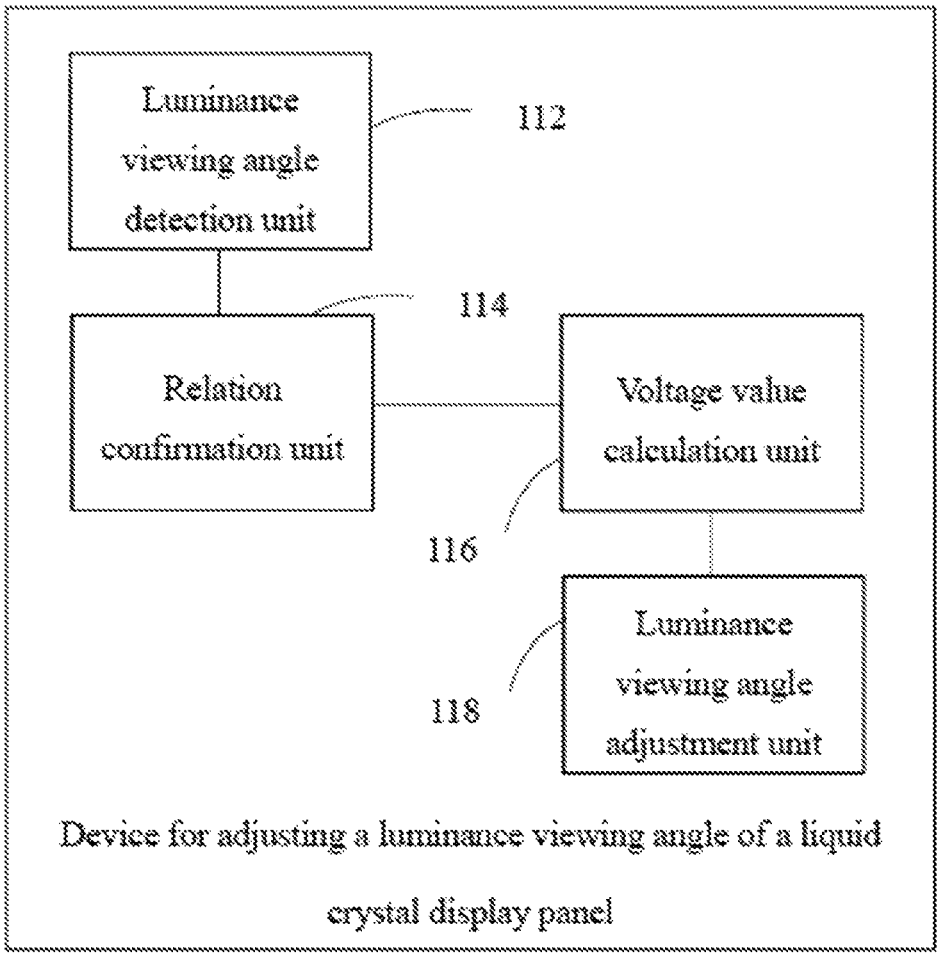
FIG. 11 is a block diagram of a device for adjusting a luminance viewing angle of a liquid crystal display panel in an embodiment.

In an embodiment as shown in FIG. 11, a device for adjusting a luminance viewing angle of a liquid crystal display panel is provided. The device includes:

a luminance viewing angle detection unit 112. Wherein, the luminance viewing angle detection unit 112 is configured to detect a luminance viewing angle of a liquid crystal display panel according to a brightness value of a current image of the liquid crystal display panel, so as to obtain an actual value of the luminance viewing angle corresponding to the current image.

a relation confirmation unit 114. When the actual value of the luminance viewing angle is less than a threshold value of the luminance viewing angle, the relation confirmation unit 114 is configured to adjust a positive and negative polarity driving voltage of the liquid crystal display panel according to a preset step size, so as to obtain a relational expression between the positive and negative polarity driving voltage and the luminance viewing angle.

a voltage value calculation unit 116. The voltage value calculation unit 116 is configured to process a difference value between the actual value of the luminance viewing angle and the threshold value of the luminance viewing angle according to the relational expression between the positive and negative polarity driving voltage and the luminance viewing angle, so as to obtain a target driving voltage value of the positive and negative polarity driving voltage.

a luminance viewing angle adjustment unit 118. The luminance viewing angle adjustment unit 118 is configured to adjust the positive and negative polarity driving voltage of the liquid crystal display panel according to the target driving voltage value.

Specific limitations of the device for adjusting the luminance viewing angle of the liquid crystal panel may refer to the foregoing limitations of the method for adjusting the luminance viewing angle of the liquid crystal display panel, and details are not described herein. Each module in the above-mentioned device for adjusting the luminance viewing angle of the liquid crystal panel may be implemented in whole or in part by software, hardware, and a combination thereof. The above-mentioned modules may be embedded or independent in form of hardware in the processor of a system for adjusting the luminance viewing angle of the liquid crystal panel. The above-mentioned modules may also be stored in form of software in a memory of the system for adjusting the luminance viewing angle of the liquid crystal panel. So that it is easy for the processor to call to perform the operations corresponding to the above modules.

Figure 12:
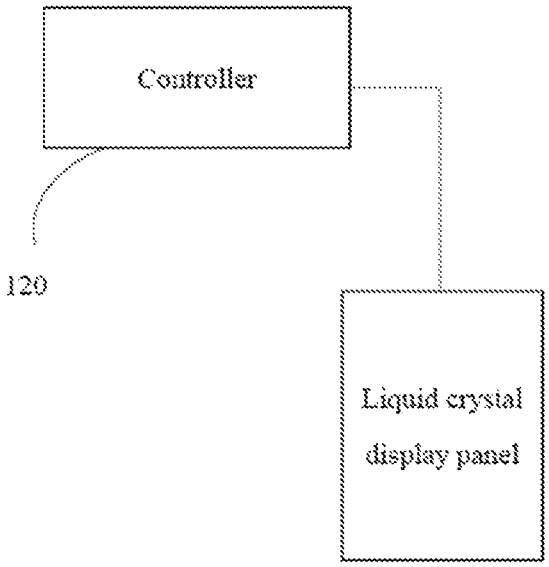
FIG. 12 is a schematic diagram of a system for adjusting a luminance viewing angle of a liquid crystal display panel in an embodiment.

In an embodiment as shown in FIG. 12, a system for adjusting a luminance viewing angle of a liquid crystal display panel is provided. The system includes a controller 120 used for connecting to a liquid crystal display panel. The controller is configured to perform any of the steps of the method for adjusting the luminance viewing angle of the liquid crystal display panel.

Wherein, the controller 120 may be, but is not limited to, a microcontroller or an ARM.

Specifically, the controller 120 may be configured to perform following steps:

detecting a luminance viewing angle of a liquid crystal display panel according to a brightness value of a current image of the liquid crystal display panel, so as to obtain an actual value of the luminance viewing angle corresponding to the current image;

when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle;

according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage; and adjusting the positive and negative polarity driving voltage of the liquid crystal display panel according to the target driving voltage value.

Specifically, the controller 120 may: detect a luminance viewing angle of a liquid crystal display panel according to a brightness value of a current image of the liquid crystal display panel, so as to obtain an actual value of the luminance viewing angle corresponding to the current image is obtained; adjust a positive and negative polarity driving voltage of the liquid crystal display panel according to a preset step size when the actual value of the luminance viewing angle is less than the threshold value of the luminance viewing angle, so as to obtain a relational expression between the positive and negative polarity driving voltage and the luminance viewing angle; process a difference value between the actual value of the luminance viewing angle and the threshold value of the luminance viewing angle according to the relational expression between the positive and negative polarity driving voltage and the luminance viewing angle, so as to obtain a target driving voltage value of positive and negative polarity driving voltage; and adjust the positive and negative polarity driving voltage according to the target driving voltage value, thereby realizing adjustment of the luminance viewing angle of the liquid crystal display panel. therefore, the adjustment of the luminance viewing angle of the liquid crystal display panel is realized without changing pixel designs, thereby saving costs, simplifying process of improving the luminance viewing angle of the liquid crystal display device, and thereby increasing improvement efficiency of the luminance viewing angle of the liquid crystal display panel.

In a specific embodiment, the system for adjusting the luminance viewing angle of the liquid crystal display panel further includes an optical measuring instrument for measuring the brightness value of the current image of the liquid crystal display panel; the optical measuring instrument is connected to the controller.

Figure 13:
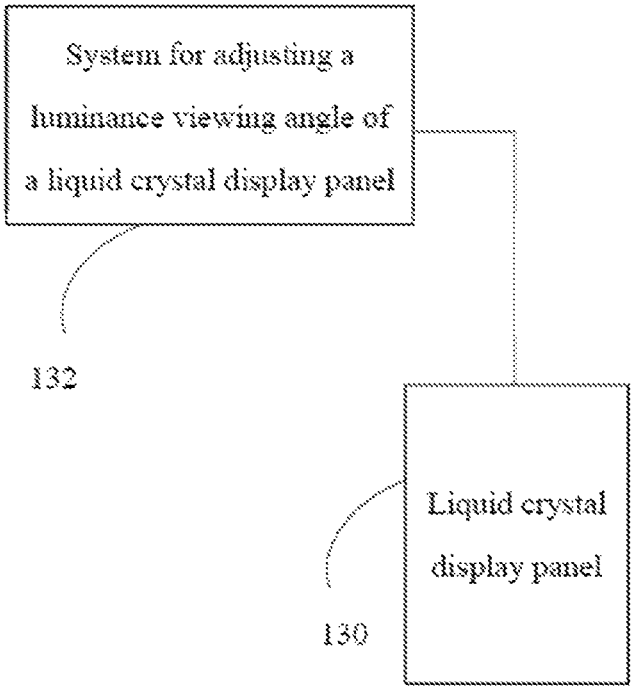
FIG. 13 is a schematic diagram of a display device in an embodiment.

In an embodiment as shown in FIG. 13, a display device is provided. The display device includes a liquid crystal display panel 130 and the system for adjusting the luminance viewing angle of the liquid crystal display panel 132 described above; the system for adjusting the luminance viewing angle of the liquid crystal display panel 132 is connected to the liquid crystal display panel.

Wherein, the liquid crystal display panel 130 may be, but is not limited to, a twisted nematic (TN) panel, a vertical alignment (VA) panel, an in-plane switching (IPS) panel, and a continuous pinwheel alignment (CPA) panel.

Specific limitations of the display device may refer to the foregoing limitations of the system for adjusting the luminance viewing angle of the liquid crystal display panel and the and method for adjusting the luminance viewing angle of the liquid crystal display panel, and details are not described herein again.

A person of ordinary skill in the art can understand that all or part of the processes in the methods of the foregoing embodiments can be implemented by using a computer program to instruct related hardware. The computer program can be stored in a non-volatile computer-readable storage medium. When the computer program is executed, the computer program may include the processes of the embodiments of the division operation methods described above. Wherein, any reference to the memory, storage, database, or other media used in the embodiments provided in this disclosure may include non-volatile and/or volatile memory. The non-volatile memory may include a read-only memory (ROM), a programmable ROM (PROM), an electrically programmable ROM (EPROM), an electrically erasable programmable ROM (EEPROM), or a flash memory. The volatile memory may include a random access memory (RAM) or an external cache memory. By way of illustration and not limitation, RAM is available in many forms, such as static RAM (SRAM), dynamic RAM (DRAM), synchronous DRAM (SDRAM), dual data rate SDRAM (DDRSDRAM), enhanced SDRAM (ESDRAM), synch link DRAM (SLDRAM), rambus direct RAM (RDRAM), direct rambus dynamic RAM (DRDRAM), rambus dynamic RAM (RDRAM), and so on.

The technical features of the embodiments described above can be arbitrarily combined. In order to simplify the description, all possible combinations of the technical features in the above embodiments are not described. However, as long as there is no contradiction in the combination of these technical features, it should be considered as the scope described in this specification.

The above-mentioned embodiments only express several implementation manners of the present disclosure, and the descriptions thereof are more specific and detailed, but cannot be understood as a limitation on the scope of the invention patent. It should be noted that, for those of ordinary skill in the art, without departing from the concept of the present disclosure, several modifications and improvements can be made, which all belong to the protection scope of the present disclosure. Therefore, the protection scope of this application patent shall be subject to the appended claims.

What is claimed is:

1. A method for adjusting a luminance viewing angle of a liquid crystal display panel, comprising following steps:

detecting a luminance viewing angle of the liquid crystal display panel according to a brightness value of a current image of the liquid crystal display panel, so as to obtain an actual value of the luminance viewing angle corresponding to the current image;

when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle;

according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage; and adjusting the positive and negative polarity driving voltage of the liquid crystal display panel according to the target driving voltage value.

2. The method for adjusting the luminance viewing angle of the liquid crystal display panel in claim 1, wherein the step of adjusting the positive and negative polarity driving voltage of the liquid crystal display panel according to the preset step size, so as to obtain the relational expression between the positive and negative polarity driving voltage and the luminance viewing angle comprises:

maintaining a negative polarity driving voltage at 255-level of the liquid crystal display panel and increasing a positive polarity driving voltage at 255-level of the liquid crystal display panel according to the preset step size, so as to obtain the relational expression between the positive and negative polarity driving voltage and the luminance viewing angle.

3. The method for adjusting the luminance viewing angle of the liquid crystal display panel in claim 1, wherein the step of adjusting the positive and negative polarity driving voltage of the liquid crystal display panel according to the preset step size, so as to obtain the relational expression between the positive and negative polarity driving voltage and the luminance viewing angle comprises:

maintaining a positive polarity driving voltage at 255-level of the liquid crystal display panel and decreasing a negative driving voltage at 255-level of the liquid crystal display panel according to the preset step size, so as to obtain the relational expression between the positive and negative polarity driving voltage and the luminance viewing angle.

4. The method for adjusting the luminance viewing angle of the liquid crystal display panel in claim 1, wherein the step of adjusting the positive and negative polarity driving voltage of the liquid crystal display panel according to the preset step size, so as to obtain the relational expression between the positive and negative polarity driving voltage and the luminance viewing angle comprises:

increasing a positive polarity driving voltage at 255-level of the liquid crystal display panel according to the preset step size and decreasing a negative driving voltage at 255-level of the liquid crystal display panel according to the preset step size, so as to obtain the relational expression between the positive and negative polarity driving voltage and the luminance viewing angle.

5. The method for adjusting the luminance viewing angle of the liquid crystal display panel in claim 1, wherein the luminance viewing angle comprises a horizontal viewing angle or a vertical viewing angle.

6. The method for adjusting the luminance viewing angle of the liquid crystal display panel in claim 5, wherein before the step of detecting the luminance viewing angle of the liquid crystal display panel according to the brightness value of the current image of the liquid crystal display panel, the method further comprises a step of:

detecting brightness of the current image at a center point of the liquid crystal display panel to obtain the brightness value.

7. The method for adjusting the luminance viewing angle of the liquid crystal display panel in claim 1, wherein the current image is an image having a 255-level brightness.

8. A device for adjusting a luminance viewing angle of a liquid crystal display panel, comprising:

a luminance viewing angle detection unit configured to detect a luminance viewing angle of a liquid crystal display panel according to a brightness value of a current image of the liquid crystal display panel, so as to obtain an actual value of the luminance viewing angle corresponding to the current image;

a relation confirmation unit configured to adjust a positive and negative polarity driving voltage of the liquid crystal display panel according to a preset step size when the actual value of the luminance viewing angle is less than a threshold value of the luminance viewing angle, so as to obtain a relational expression between the positive and negative polarity driving voltage and the luminance viewing angle;

a voltage value calculation unit configured to process a difference value between the actual value of the luminance viewing angle and the threshold value of the luminance viewing angle according to the relational expression between the positive and negative polarity driving voltage and the luminance viewing angle, so as to obtain a target driving voltage value of the positive and negative polarity driving voltage; and a luminance viewing angle adjustment unit configured to adjust the positive and negative polarity driving voltage of the liquid crystal display panel according to the target driving voltage value.

9. A system for adjusting a luminance viewing angle of a liquid crystal display panel, wherein the system comprises a controller configured to be connected to the liquid crystal display panel, the controller is configured to perform following steps:

detecting a luminance viewing angle of the liquid crystal display panel according to a brightness value of a current image of the liquid crystal display panel, so as to obtain an actual value of the luminance viewing angle corresponding to the current image;

when the actual value of the luminance viewing angle is less than a threshold value of the luminance viewing angle, adjusting a positive and negative polarity driving voltage of the liquid crystal display panel according to a preset step size, so as to obtain a relational expression between the positive and negative polarity driving voltage and the luminance viewing angle;

according to the relational expression between the positive and negative polarity driving voltage and the luminance viewing angle, processing a difference value between the actual value of the luminance viewing angle and the threshold value of the luminance viewing angle to obtain a target driving voltage value of the positive and negative polarity driving voltage; and adjusting the positive and negative polarity driving voltage of the liquid crystal display panel according to the target driving voltage value.

* * * * *